US005620623A

United States Patent [19]

Baker

[11] Patent Number: 5,620,623

[45] Date of Patent: Apr. 15, 1997

[54] THERMAL BLEND CONVECTION OVEN

[75] Inventor: Richard L. Baker, Lewisburg, Ohio

[73] Assignee: Whirlpool Corporation, Benton Harbor, Mich.

[21] Appl. No.: 592,773

[22] Filed: Jan. 26, 1996

Related U.S. Application Data

[63] Continuation of Ser. No. 278,291, Jul. 21, 1994, abandoned.

[51] Int. Cl.[6] ..... H05B 1/02

[52] U.S. Cl. ..... 219/400; 126/21 A

[58] Field of Search ..... 219/400, 681, 219/682, 685; 126/21 A

[56] References Cited

U.S. PATENT DOCUMENTS

| | | | |
|---|---|---|---|
| 1,243,605 | 10/1917 | Howell . | |
| 2,839,044 | 6/1958 | Phares | 126/39 |
| 3,221,729 | 12/1965 | Beasley et al. | 126/21 |
| 3,288,129 | 11/1966 | Fox | 126/19.5 |
| 3,379,189 | 4/1968 | Staples | 126/21 |
| 3,414,708 | 12/1968 | Maier | 219/400 |
| 3,626,922 | 12/1971 | Borge | 126/21 |
| 3,839,622 | 10/1974 | Mastin | 219/400 |
| 4,109,636 | 8/1978 | Burge | 126/21 |
| 4,236,063 | 11/1980 | Glucksman | 219/400 |
| 4,335,290 | 6/1982 | Teich | 219/681 |
| 4,516,012 | 5/1985 | Smith et al. | 219/400 |
| 4,527,538 | 7/1985 | Caferro | 126/21 |
| 4,536,643 | 8/1985 | Erickson | 219/400 |
| 4,591,698 | 5/1986 | Chang | 219/400 |
| 4,598,691 | 7/1986 | Herrelko et al. | 126/41 |
| 4,644,136 | 2/1987 | Watchman | 219/400 |
| 4,702,158 | 10/1987 | Ishihara | 99/323 |
| 4,771,162 | 9/1988 | Schatz et al. | 219/400 |
| 4,851,644 | 7/1989 | Oslin | 219/400 |
| 4,908,488 | 3/1990 | Park | 219/10.55 |
| 5,038,748 | 8/1991 | Lockwood et al. | 126/19 |

FOREIGN PATENT DOCUMENTS

| | | | |
|---|---|---|---|
| 468534 | 1/1953 | Italy | 219/400 |

*Primary Examiner*—Philip H. Leung
*Attorney, Agent, or Firm*—Thomas A. Schwyn; Robert O. Rice; Mark A. Davis

[57] ABSTRACT

A thermal convection oven comprises an enclosure housing an oven cavity having connected rear, top, bottom and side walls to define an oven space having a front opening. A door is hingedly mounted to the enclosure about the front opening providing selective access to the oven space. A bottom plate is mounted in the oven space above the bottom wall separating a heated space from a cooking space, the plate having peripheral bottom vent openings. A heating element is disposed in the heated space. A blower fan is disposed in the heated space in proximity to the heating element. A top vent opening is in the cavity above the bottom plate. The blower fan circulates air heated by the heating element through the bottom vent openings into the cooking space and out the top vent openings.

19 Claims, 2 Drawing Sheets

THERMAL BLEND CONVECTION OVEN

This is a continuation of application Ser. No. 08/278,291, filed Jul. 21, 1994 now abandonded.

FIELD OF THE INVENTION

This application relates to an oven and, more particularly, to a thermal blend convection oven.

BACKGROUND OF THE INVENTION

Freestanding cooking ranges comprise an enclosure having a generally flat cook top with cooking elements and an oven cavity. Such ranges are typically referred to as thermal ovens and are of the gas or electric type. The gas range includes gas burners on the cook top, as well as a gas burner within the oven cavity. Similarly, an electric range includes electric heating elements on the cook top and one or more electric heating elements within the oven cavity.

The oven cavity generally comprises connected rear, top, bottom, and side walls to define an oven space having a front opening. Rails are formed in the side walls for supporting oven racks. In a gas oven the burner is typically disposed between a bottom panel and the bottom wall for heating the oven space. An electric oven may use the same oven cavity. However, the bottom plate is eliminated so that the electric heating element is exposed. The exposed heating element can make cleaning the oven cavity more difficult.

An alternative type of oven comprises a convection oven. A convection oven includes an electric heating element and a blower fan for circulating air heated by the heating element within the oven space. Circulating air is returned to the fan so that the heated air is, in effect, recirculated within the cooking space. This allows food to be cooked at lower temperatures or for shorter periods of time.

A typical oven includes a door gasket surrounding the top and sides of the door, but not the bottom. The lack of a bottom gasket provides an air gap so that air can be drawn in at the bottom of the door. However, with self-cleaning ovens this air can present difficulty in that cold air entering at the bottom of the door might prevent the front bottom wall from being completely cleaned.

A convection oven often includes the fan mounted at the back wall of the cavity with a deflector plate frontwardly of the fan. This structure reduces available depth in the oven cavity, providing a smaller cooking space. The smaller cooking space precludes the use of oven racks of the same size as used in the conventional thermal oven.

The present invention is intended to solve one or more of the problems discussed above in a novel and simple manner.

SUMMARY OF THE INVENTION

In accordance with the invention there is provided a thermal blend convection oven.

In accordance with another aspect of the invention there is provided a convection oven using an oven cavity suitable for gas or electric ovens.

In accordance with yet a further aspect of the invention there is disclosed an electric oven including an unexposed heating element.

Broadly, there is disclosed herein a thermal convection oven comprising an enclosure housing an oven cavity having connected rear, top, bottom and side walls to define an oven space having a front opening. A door is hingedly mounted to the enclosure about the front opening providing selective access to the oven space. A bottom plate is mounted in the oven space above the bottom wall separating a heated space from a cooking space, the plate having peripheral bottom vent openings. A heating element is disposed in the heated space. A blower fan is disposed in the heated space in proximity to the heating element. A top vent opening is in the cavity above the bottom plate. The blower fan circulates air heated by the heating element through the bottom vent openings into the cooking space and out the top vent openings.

It is a feature of the invention that the bottom plate is removable.

It is another feature of the invention to provide a deflector plate disposed in the heated space between the heating element and the bottom wall.

It is another feature of the invention that the bottom wall comprises an insulated wall having a through opening and the blower fan comprises a motor having a shaft, the motor being positioned below the bottom wall with the shaft extending through the opening. A fan blade is secured to a distal end of the shaft, the fan blade drawing exterior air through the opening around the motor shaft.

It is another feature of the invention that the heating element comprises an electrical ring element surrounding the blower.

It is yet another feature of the invention that the door includes a gasket completely surrounding the opening.

It is still another feature of the invention that the top vent opening is in the top wall.

In accordance with another aspect of the invention there is disclosed an electric oven comprising an enclosure housing an oven cavity having connected rear, top, bottom and side walls to define an oven space having a front opening. A door is hingedly mounted to the enclosure about the front opening to provide selective access to the oven space. An electric heating element is centrally disposed in the oven space at the bottom wall. A bottom plate is mounted in the oven space above the heating element and separating a heated space from a cooking space, the plate spanning across the cavity to completely cover the heating element.

There is disclosed in accordance with a further aspect of the invention a free-standing range having an enclosure housing an oven cavity having connected rear, top, bottom and side walls to define an oven space having a front opening and a door hingedly mounted to the enclosure about the front opening and providing selective access to the oven space. The oven cavity is adapted to house conventional gas or electric heating elements and includes a top vent opening. A thermal convection heating system comprises a bottom plate mounted in the space above the bottom wall separating a heated space from a cooking space, the plate having peripheral bottom vent openings. An electric heating element is disposed in the heated space. A blower fan is disposed in the heated space in proximity to the heating element, wherein the blower fan circulates air heated by the heating element through the bottom vent openings into the cooking space and out the top vent openings.

Further features and advantages of the invention will readily be apparent from the specification and from the drawing.

DETAILED DESCRIPTION OF THE INVENTION

Figure 1:
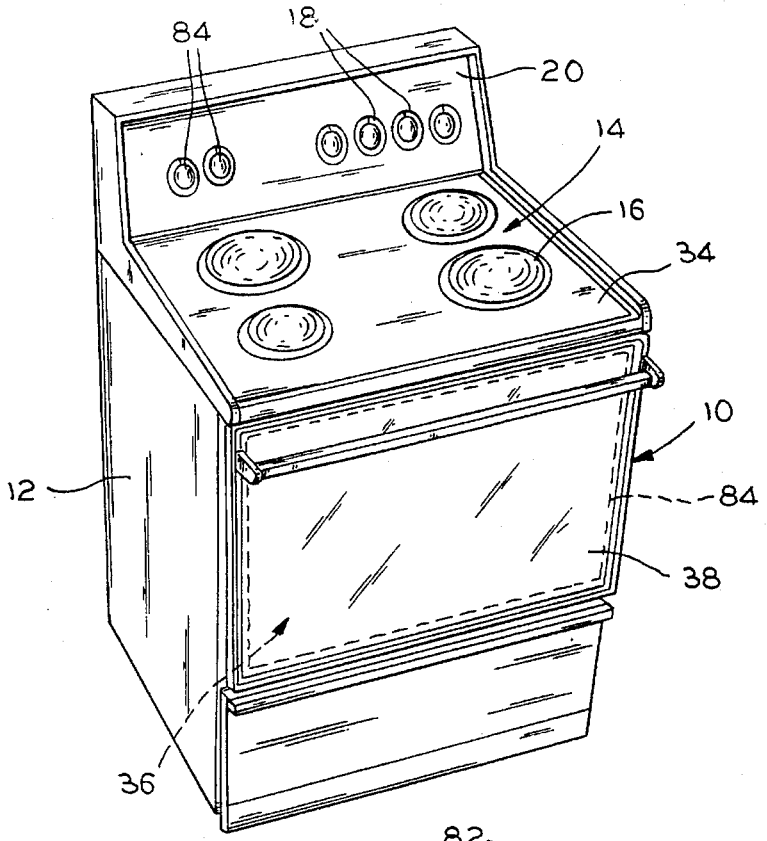
FIG. 1 is a perspective view of a free-standing range including a thermal convection oven according to the invention.
Figure 2:
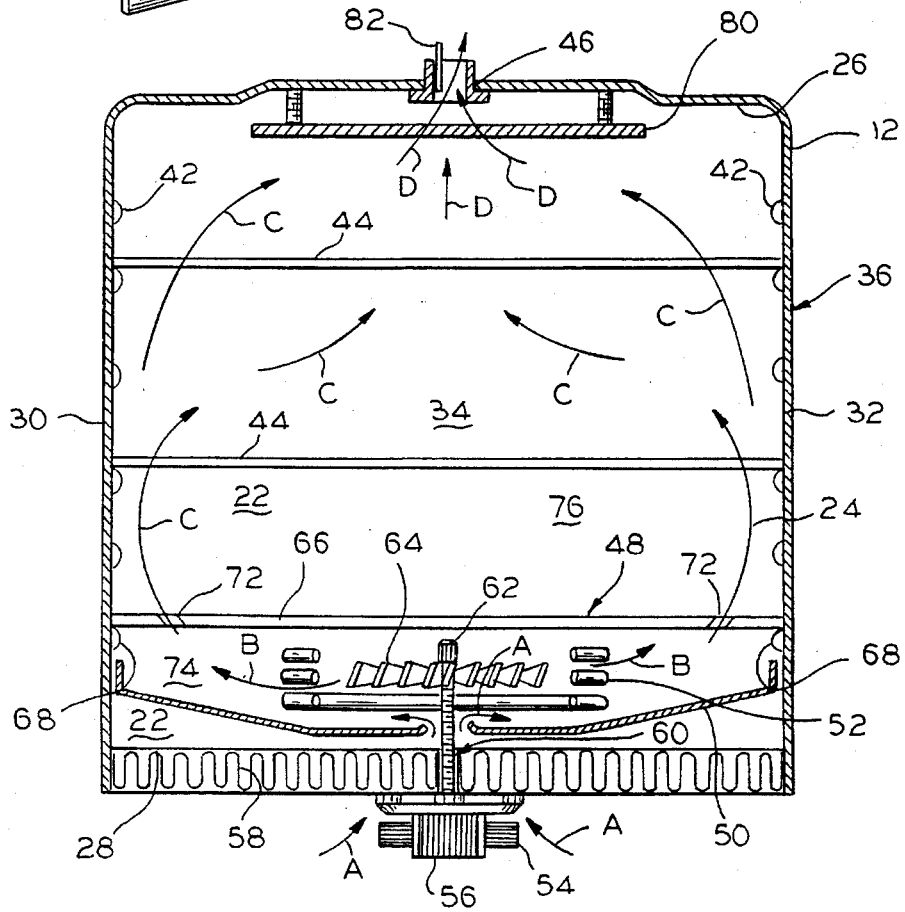
FIG. 2 is a section, front elevation view of the oven cavity for the range of FIG. 1.
Figure 3:
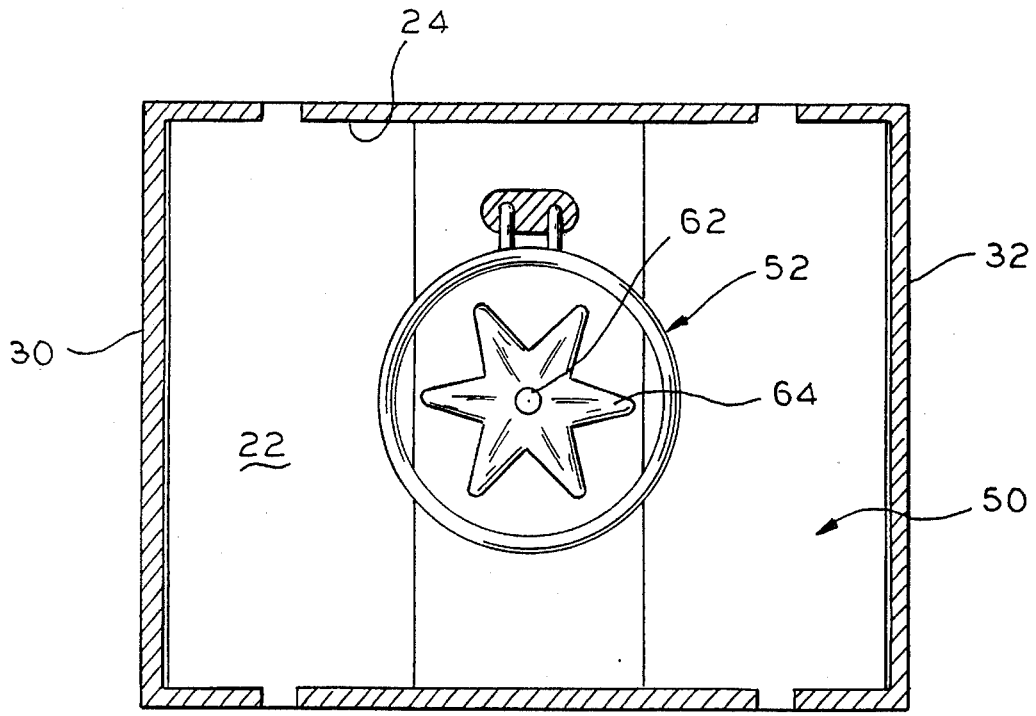
FIG. 3 is a top plan view of the oven cavity of FIG. 2 with a bottom plate removed.

With reference to FIG. 1, a free-standing range 10 includes an enclosure 12 having a cook top 14 with suitable surface elements 16. The surface elements 16 are controlled by control knobs 18 on a control panel 20. With reference also to FIGS. 2 and 3, the enclosure 12 also houses an oven cavity 22. The oven cavity 22 has a connected rear wall 24, top wall 26, bottom wall 28 and opposite side walls 30 and 32 to define an oven space 34 having a front opening 36. A door 38 is hingedly mounted to the enclosure 12 about the front opening 36 providing selective access to the oven space 34.

Each side wall 30 and 32 includes formed rails 42 for supporting oven racks 44. A vent opening 46 is provided in the top wall 26.

As described, the oven cavity 22 can be used with conventional thermal heating systems of the gas or electric type.

In accordance with the invention, the cavity 22 includes a thermal convection heating system 48. The heating system 48 comprises a heat deflector plate 50 disposed immediately above the bottom wall 28. A ring heating element 52 is mounted immediately above the deflector plate 50. A blower fan 54 is disposed in proximity to the heating element 52. Particularly, the blower fan 54 includes a motor 56 mounted beneath the bottom wall 28. The bottom wall 28 includes a body of insulation 58 therein having a central opening 60. The motor 56 drives a shaft 62 extending through the opening 60 and having a fan blade 64 secured at a distal end thereof. Particularly, the fan blade 64 is coaxial with and surrounded by the ring heating element 52.

Figure 4:
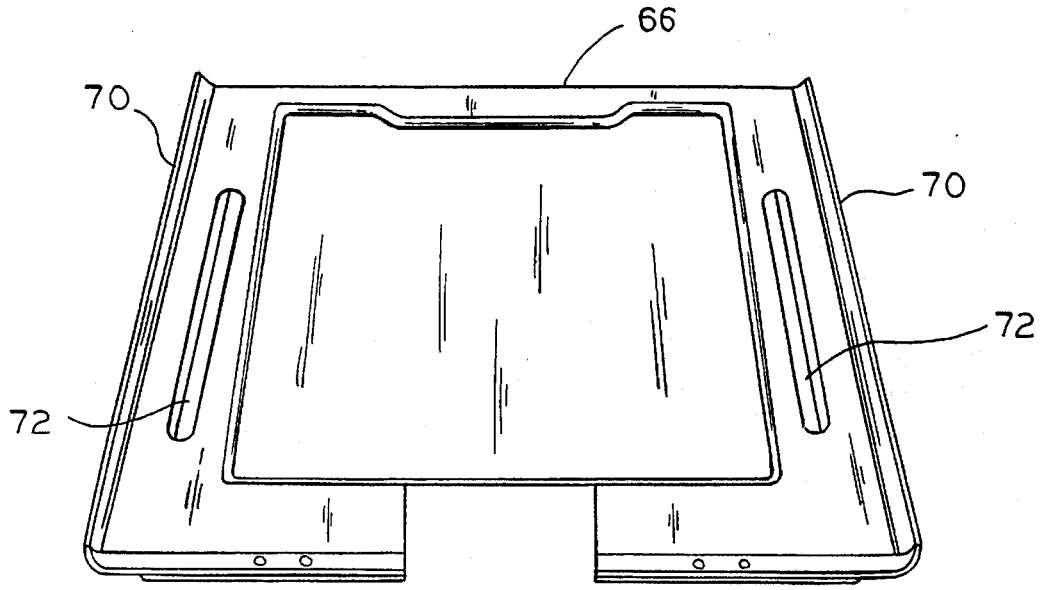
FIG. 4 is a perspective view of the bottom plate for the oven cavity of FIG. 2.

A removable bottom plate 66 is received in the oven space 34 on lower rails 68. With reference also to FIG. 4, the bottom plate is of a size and shape corresponding to the oven space 34. The bottom plate 66 includes opposite side edges 70 for resting on the rails 68. Provided adjacent each side edge 70 is an elongate slot 72. Particularly, the slots 72 define bottom vent openings. As installed, the bottom plate 66 separates a heated space 74 from a cooking space 76.

A broiler element 80 is mounted in the cooking space 76 at the top wall 26. A temperature probe 82 is mounted in the vent opening 46 for sensing temperature in the cooking space 76. Although not shown, a conventional catalyst could be installed in the vent opening 46.

In the illustrated embodiment of the invention, the ring element 52 is rated at 2400 watts at 240 $V_{AC}$. The convection fan 54 is rated at 1300 RPM. The broiler element 80 is a dual element having an outer element rated at 100 watts and an inner element rated at 1660 watts, each at 240 $V_{AC}$.

The door 38 is sealed to the enclosure 22 with a gasket 84 which completely surrounds the front opening 36. As a result, air enters the oven space 34 only through the space between the motor shaft 62 and bottom wall opening 60 and through the top vent opening 46.

In accordance with the invention, the thermal convection heating system 48 provides the benefits of both thermal cooking and convection cooking. Oven temperature is controlled in accordance with temperature sensed by the probe 82 and oven control knobs 84, see FIG. 1. One control knob 84 controls the broiler element 80. The other control knob 84 controls the thermal convection heating system 48. Particularly, when heating is called for, the heating element 52 is energized and the blower fan 54 is turned on. The fan blade 64 draws ambient air through the openings 60, as indicated by arrows labeled "A". The ambient air is heated as it passes by the heating element 52, as indicated by arrows labeled "B". The heated air is deflected upwardly by the deflector plate 50 so that it exits the heated space 74 through the bottom vent openings 72 for circulation within the cooking space 76, as indicated by the arrows labeled "C". The air is then exhausted through the top vent opening 46, as represented by the arrows labeled "D".

As described above, a conventional convection oven recirculates air within the cooking space. The thermal convection system 48 according to the invention does not recirculate air within the cooking space 76. The bottom plate 66 spanning across the oven space 34 provides no means for the heated air in the oven space 76 to return to the heated space 74. Instead, such air is exhausted through the top vent opening 46. This heating system 48 provides a gentler air flow within the cooking space 76. This gentler air flow results in more even browning of items being cooked. As also mentioned above, a conventional convection oven cooks food products either at a lower temperature or shorter time periods. The thermal convection heating system 48 in accordance with the invention by not recirculating air permits food items to be cooked at the same temperature and for the same times as with a conventional thermal oven. Therefore, there is no necessity of modifying existing recipes to adapt to a convection oven.

The bottom plate 66 spanning the oven cavity 22 completely covers the heating element 52. Thus, easier cleaning results by not exposing the heating element 52. Indeed, the bottom plate 66 can be simply cleaned by being removed from the oven space 34.

By installing the thermal convection heating system 48 at the bottom of the oven space 34, a common oven cavity design can be used as is currently used for gas or electric ovens and using similar oven racks and the like. This feature provides economies of scale to lower manufacturing costs. Also, a larger oven cavity is provided than with a conventional convection oven having rear wall mounted heating systems.

By mounting the convection motor 56 below the bottom wall 28, it is disposed in a cooler environment to extend motor life.

Thus, the thermal convection heating system 48 "blends" the features and benefits of thermal ovens and convection ovens. Particularly, food items can be cooked using conventional oven recipes while providing more even heat distribution than with either a conventional thermal oven or conventional convection oven. The thermal convection heating system 48 also provides the attributes of convection ovens, namely the ability to dehydrate food products, while also cooking a whole meal at one time. This latter feature allows different products to be cooked on different racks, which generally cannot be accomplished with conventional thermal ovens.

Moreover, by completely sealing the door 38 a self-cleaning function operates better as by eliminating cold air entering at the bottom of the door 38.

The disclosed embodiment of the invention is illustrative of the broad inventive concepts comprehended by the invention.

I claim:

1. A thermal convection oven for cooking food comprising:

enclosure having rear, top, bottom, and side walls defining an oven space with a front opening providing selective access to the oven space;

a door pivotally mounted to the enclosure at the front opening and moveable relative to the enclosure between an open and a closed position to cover and uncover the opening to provide selective access to the oven space;

a bottom plate mounted in the oven space above the bottom wall, separating the oven space into a heated space in a cooking space;

a heating element disposed in the heated space;

the bottom plate being sized to cover the heating element and the bottom plate having at least one vent opening positioned on the bottom plate not directly above the heating element so that any spills in the enclosure will not directly contact the heating element;

a fan disclosed in the heated space;

a deflector disposed within the heated space, a portion of which is positioned below the fan for deflecting the flow of air from the fan upwardly through the at least one vent opening and into the cooking space; and the enclosure having an inlet opening and an outlet opening, wherein the fan draws air into the enclosure through the inlet opening, where it is heated by the heater and circulates the heated air through the vent opening, with the air finally exiting the enclosure through the outlet opening.

2. A thermal convection oven as claimed in claim 1, wherein the deflector has a generally planar body with upwardly sloped ends for deflecting upwardly the air blown by the fan.

3. A thermal convection oven as claimed in claim 2, wherein the at least one vent opening is positioned over one of the upwardly sloped ends.

4. A thermal convection oven as claimed in claim 1, and further comprising at least one oven rack positioned within the cooking space above the bottom plate for supporting food to be cooked in the oven.

5. A thermal convection oven as claimed in claim 1, wherein the inlet opening is in the heated space and the outlet opening is in the cooking space.

6. A thermal convection oven as claimed in claim 1, wherein the fan comprises a power source having a drive shaft and a fan blade mounted on the drive shaft, and the power source is positioned below the heater.

7. A thermal convection oven as claimed in claim 6, wherein the inlet opening is in the bottom wall of the enclosure and the drive shaft extends through the inlet opening such that the fan blade is positioned within the heated space and the power source is positioned below the bottom wall.

8. An thermal convection oven as claimed in claim 1, wherein the deflector plate disposed in the heated space below the heater.

9. A thermal convection oven as claimed in claim 8, wherein the deflector has a generally planar body with upwardly sloped ends for deflecting upwardly the air blown by the fan.

10. A thermal convection oven as claimed in claim 9, wherein the at least one vent opening is positioned over one of the upwardly sloped ends.

11. A thermal convection oven as claimed in claim 1, wherein the bottom plate extends substantially across the oven space and covers the heating element to protect it from direct contact with spilled cooking material.

12. A thermal convection oven as claimed in claim 11, wherein the deflector has a generally planar body with upwardly sloped ends for deflecting upwardly the air blown by the fan and the at least one vent opening is positioned over one of the upwardly sloped ends.

13. A thermal convection oven as claimed in claim 1, wherein said bottom plate is removable.

14. A thermal convection oven as claimed in claim 1, wherein said bottom wall comprises an insulated wall having a through opening and said fan comprises a motor having a shaft, the motor being positioned below said bottom wall with said shaft extending through said opening, and a fan blade secured to distal end of said shaft, said fan blade drawing exterior air through said through opening around said motor shaft.

15. A thermal convection oven as claimed in claim 1, wherein said heating element comprises an electrical ring element surrounding said fan.

16. A thermal convection oven as claimed in claim 1, wherein said door includes a gasket completely surrounding said opening.

17. A thermal convection oven as claimed in claim 1, wherein said outlet opening is in said top wall.

18. A thermal convection oven as claimed in claim 1, wherein said at least one vent opening is a plurality of peripheral bottom vent openings.

19. A thermal convection oven as claimed in claim 18, wherein the outlet opening is a top vent opening in said enclosure above said bottom plate and the fan circulates air heated by said heating element through said bottom vent openings into said cooking space and out said top vent opening.

* * * * *